US007232167B2

(12) United States Patent
Edwards

(10) Patent No.: US 7,232,167 B2
(45) Date of Patent: Jun. 19, 2007

(54) CAM-ACTION PIPE PULLER

(76) Inventor: Grady Odell Edwards, 2917 Clarkshaw Rd., Powell, OH (US) 43085-8961

( * ) Notice: Subject to any disclaimer, the term of this patent is extended or adjusted under 35 U.S.C. 154(b) by 177 days.

(21) Appl. No.: 10/121,411

(22) Filed: Apr. 12, 2002

(65) Prior Publication Data

US 2002/0185879 A1 Dec. 12, 2002

Related U.S. Application Data

(60) Provisional application No. 60/296,516, filed on Jun. 8, 2001.

(51) Int. Cl.
*B66C 1/56* (2006.01)

(52) U.S. Cl. ..... 294/95; 294/86.25

(58) Field of Classification Search ..... 294/93, 294/94, 95, 96, 97, 86.24, 86.25
See application file for complete search history.

(56) References Cited

U.S. PATENT DOCUMENTS

| | | | | | |
|---|---|---|---|---|---|
| 718,066 | A * | 1/1903 | McWilliams | ..... | 294/86.25 |
| 967,566 | A * | 8/1910 | Russell | ..... | 294/95 |
| 1,804,843 | A * | 5/1931 | Santiago | ..... | 294/93 |
| 2,271,206 | A * | 1/1942 | Pollard et al. | ..... | 294/95 |
| 2,634,156 | A * | 4/1953 | Crimmel | ..... | 294/95 |
| 2,778,671 | A * | 1/1957 | Langston | ..... | 294/95 |
| 2,946,616 | A * | 7/1960 | Carter | ..... | 294/96 |
| 3,167,310 | A * | 1/1965 | Rosekrans | ..... | 294/95 |
| 3,442,546 | A * | 5/1969 | Bachman | ..... | 294/95 |
| 4,173,368 | A * | 11/1979 | Haverbusch | ..... | 294/93 |
| 5,527,078 | A * | 6/1996 | Messick | ..... | 294/95 |
| 5,988,719 | A * | 11/1999 | Lavender | ..... | 294/96 |
| 6,311,380 | B1 * | 11/2001 | Chen | ..... | 29/259 |
| 6,511,113 | B1 * | 1/2003 | Kulage | ..... | 294/97 |

FOREIGN PATENT DOCUMENTS

| | | | | |
|---|---|---|---|---|
| CH | 403230 | * 6/1966 | ..... | 294/94 |
| GB | 24896 | * 10/1914 | ..... | 294/96 |
| GB | 2080243 | * 2/1982 | | |
| SU | 1407895 | * 7/1988 | ..... | 294/95 |

* cited by examiner

*Primary Examiner*—Patrick Mackey
*Assistant Examiner*—Paul T. Chin
(74) *Attorney, Agent, or Firm*—Dwight A. Marshall

(57) ABSTRACT

A cam-operated pipe puller for pulling and extracting a pipe through a conduit wherein the pipe puller has members for grasping the inner sides of the pipe and apparatus attached to the grasping members for holding the grasping members in a retained position as they are initially inserted into the pipe and for releasing and expanding the grasping members to engage the inner surface of the pipe after the grasping members are fully inserted into the pipe so as to pull and extract the pipe from and through the conduit.

12 Claims, 3 Drawing Sheets

Section A-A'

CAM-ACTION PIPE PULLER

This application is entitled to priority under 35 U.S.C. 119(e) due to provisional application Ser. No. 60/296,516 filed on Jun. 8, 2001.

FIELD OF THE INVENTION

The invention relates to pipe pulling apparatus and in particular to a cam operated pipe puller for installing and removing underground pipes.

BACKGROUND OF THE INVENTION

Underground wells are often used as water sources especially in suburban areas to supply water taken from an underground source of water to supply water to dwelling and commercial structures located on the surface near the source of water. After the underground water source has been located, a submersible pump is inserted into the source of water so that the pump may pump water through a pipe attached to the pump to the surface. After the underground water source has been located, well digging apparatus is brought to the location to start the process of installing the pump. Typically, a hole or conduit is dug from the surface to the source of the water and is of such a diameter to receive a casing of a size sufficient to slidably receive the pump. The pump and water pipe attached thereto for transporting the water from the pump to the surface is lowered through the casing so that the pump may be submerged in the water. In operation, the pump is operated to pump water from the water source through the attached pipe to the surface for use by the dwelling and commercial structures.

A problem arises in that the pump may become inoperative and require either repair or replacement. In addition, the water pipe attached to the submersible pump may develop leaks and also require replacement. Over a period of time it becomes difficult to remove the pump and piping through the casing and it becomes necessary to dig another hole and install new casing and another pump and attached pipe.

In other applications, piping is horizontally installed in conduits so that liquids such as water may be transported from one location to another distant location. In addition, the horizontally installed piping may be conduits to receive cabling that connects one location to another. Typically, the concept of directional boring is used to drill a horizontal underground conduit that connects the one location to the distant location. The piping is then pulled through the drilled horizontal conduit from the one location to the distant location. In the pulling operation, a collar may be fitted around the outer diameter of the pipe at one location and attached to a pulling cable extending through the horizontal conduit to the distant location such that the pulling cable may be used to pull the piping or conduit through the horizontal hole. In another operation, the pulling cable may be welded to the piping to be pulled through the horizontal or slanted conduit. Problems arise with these operations in that they take time to prepare the piping and conduit for the pulling operation and it is required to bore a larger hole then is necessary to just pull the piping through the hole.

Accordingly, a need exists in the art for apparatus to remove vertical piping and attached submersible pump from underground well operations and to pull piping structures through horizontal, vertical or slanted conduits without attaching collars or to weld the pulling cable to the piping.

SUMMARY OF THE INVENTION

It is an object of the invention to provide a pipe puller for pulling and extracting a pipe through a conduit wherein the pipe puller has grasping members for engaging the inner sides of the pipe and apparatus attached to the grasping members for retaining the grasping members as they are initially inserted into the pipe and for expanding the grasping members to engage the inner sides of the pipe after the grasping members are inserted into the pipe so that the pipe may be pulled through or extracted from the conduit.

It is also an object of the invention to provide a pipe puller for pulling and extracting a pipe through a conduit wherein the pipe puller has a plurality of grasping members each positioned at ninety degrees around a center axis of the pipe puller from each adjacent grasping member and each having an arc-configured outer serrated surface formed to engage a portion of an inner surface of the pipe so as to enable the pipe puller to pull the pipe through the conduit and each having an inner surface with a triangular configured cam follower having a back section affixed thereto with a hypotenuse section thereof extending toward the pipe puller center axis.

It is also an object of the invention to provide a pipe puller for pulling and extracting a pipe through a conduit wherein the pipe puller has grasping members each having an outer serrated surface and a cam follower and having plunger apparatus for retaining ends of the grasping members with upper ends of the grasping members positioned such that the diameter of top segments of the retained grasping members is greater than the diameter of the inside of the pipe when the pipe puller is initially inserted into the pipe and which plunger apparatus may be further inserted into pipe to release the ends of the grasping members and which has a cam member affixed thereto so that movement of the plunger apparatus in the opposite direction positions the cam member to engage the cam followers to force the grasping members to engage the inner sides of the pipe thereby enabling the pipe to be removed from the conduit.

In a preferred embodiment of the invention, a cam-action pipe puller for pulling and extracting a pipe through a conduit has a plurality of grasping members each having an arc-configured outer serrated surface formed to engage a portion of an inner surface of the pipe so as to enable the pipe puller to pull the pipe through the conduit. The apparatus has a threaded eye bolt affixed at one end to a retaining member provided for engaging a lower end of each grasping member and for guiding an end of the pipe puller into the pipe while retaining the grasping members as the pipe puller is initially inserted into the pipe. A circular top cap is slidably positioned on a upper portion of the threaded eye bolt opposite the retaining member and is formed of a diameter enabling the top cap to slidably move along the inner sides of the pipe. The pipe puller apparatus has a generally square configured supporting member affixed to the bottom of the circular top cap and which is slidably positioned on an upper portion of the threaded eye bolt and formed with rounded corners sized to slidably move along the inner sides of the pipe. The supporting member movably supports an upper end of each grasping member such that the grasping members are positioned at ninety degrees about an axis of the threaded eye bolt. The diameter of the arc-configured outer surfaces at the top segments of the grasping members is greater than the diameter of the inside of the pipe when retained by the retaining member and is less than the pipe inside diameter when the grasping members are released by the retaining member thereby enabling the supporting member and supported grasping members released by the retainer member to slidably move along the inner sides of the pipe. A plurality of generally right triangular configured cam followers each have a back section affixed to the inner surface of a corresponding grasping member such that a hypotenuse section of the cam follower is formed to extend outward from the inner surface of the grasping member toward the axis of the eye bolt. The pipe puller apparatus has a cam member affixed to the eye bolt member between the grasping members supporting member and the retainer member in a position normally disengaged from the grasping members cam followers when they are engaged by the retaining member and positioned to engage the hypotenuse section of the cam followers as the eye bolt is moved outward with respect to the pipe to force the serrated surface of each grasping member to engage the inner surfaces of the pipe and pull pipe from and through the conduit.

BRIEF DESCRIPTION OF THE DRAWING

For a further understanding of the objects and advantages of the present invention, reference should be had to the following detailed description, taken in conjunction with the accompanying drawing figures, in which like parts are given like reference numerals and wherein.

DETAILED DESCRIPTION OF THE INVENTION

Figure 1:
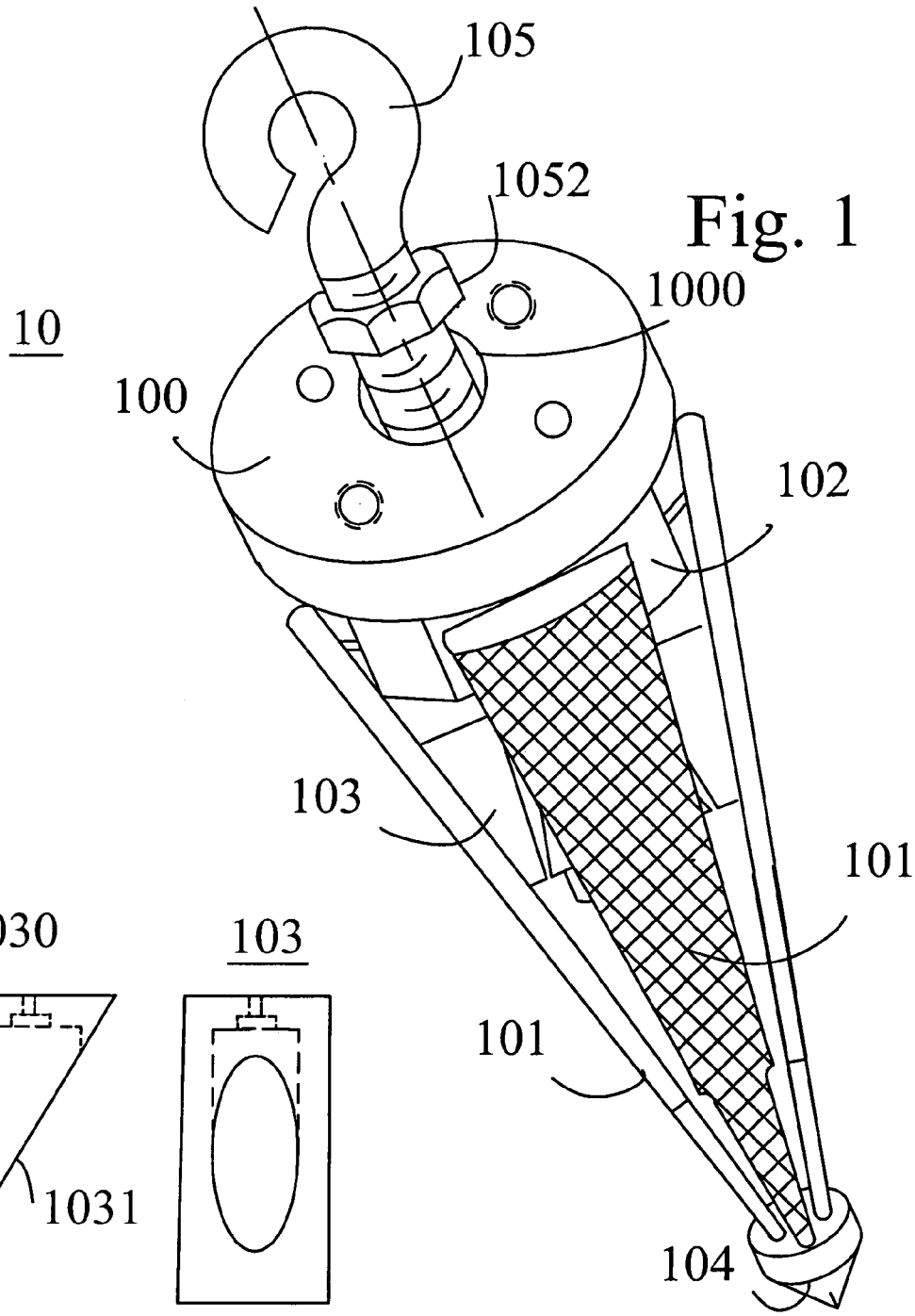
FIG. 1 is an overall view of cam-action pipe puller apparatus in accordance with the principles of the invention.

In an exemplary embodiment of the invention, the cam-action pipe puller apparatus, set forth in FIG. 1 of the drawing and hereinafter referred as pipe puller 10, is intended for use in pulling pipe and submersible pumps from underground wells and to install pipes in underground conduits by pulling the pipe through conduits. In underground well operations, a hole, hereinafter referred to as a conduit, is drilled from the surface down through the earth to the source of water and a casing is inserted within the hole to extend from the surface to the source of water. A submersible pump with a pipe 20, FIG. 2, attached thereto is installed in the conduit such that the pump is submerged in the water source so that water may be pumped through the pipe to the surface. In another operation it may be desirable to install a pipe from one location to a distant location. In this operation, a vertical, horizontal or slanted hole, which is referred to as a conduit in this particular operation, is drilled from the one location to the distant location and the pipe is pulled from the one location through the conduit to the other. The term conduit as used herein may be the well casing or other types of holes or passageways in which pipes are to be removed or installed.

Pipe puller 10, FIG. 1, is arranged for pulling a pipe through a horizontal, vertical or slanted conduit, and for extracting a pipe and submersible pump connected thereto through various configurations of conduits. The pipe puller apparatus has a plurality of grasping members 101 each positioned at ninety degree intervals around a center axis of pipe puller 10 for engaging inner sides of the pipe 20. Although four grasping members 101 are set forth in FIG. 1, it is to be understood that other numbers of grasping members may be used in variations of the instant pipe puller 10. In general, each grasping member 101 may, although not necessarily limited thereto, have a file configuration where the broad portion of the configuration is at the top and which tapers off to a tail section at the bottom.

Figure 8:
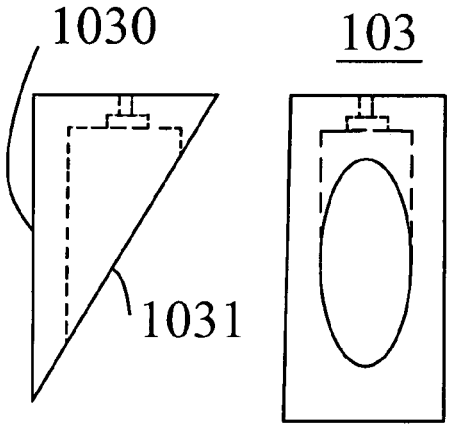
FIG. 8, illustrates side and front views of the cam followers set forth in FIGS. 1, 2 and 3, and FIG. 9. illustrates a retainer member for retaining the grasping members set forth in FIGS. 1 and 2 as the pipe puller apparatus set forth in FIG. 1 is initially inserted into a pipe.
Figure 2:
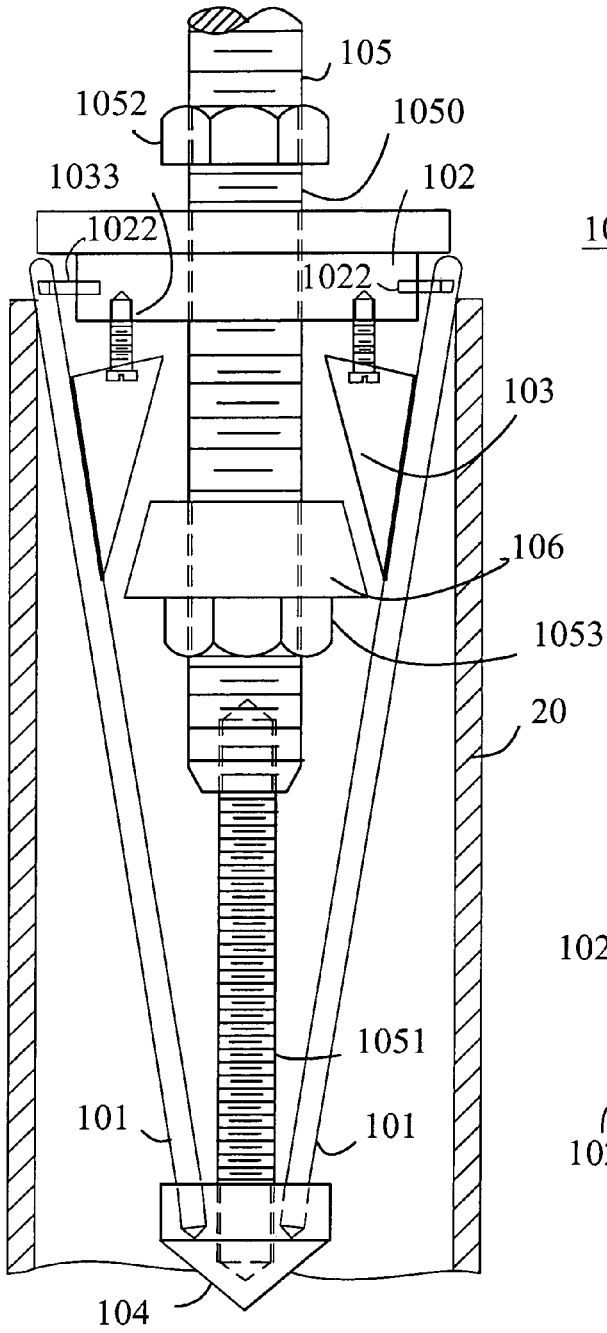
FIG. 2 illustrates the cam-action pipe puller apparatus set forth in FIG. 1 being initially inserted in a pipe to be installed or removed from a conduit.
Figure 3:
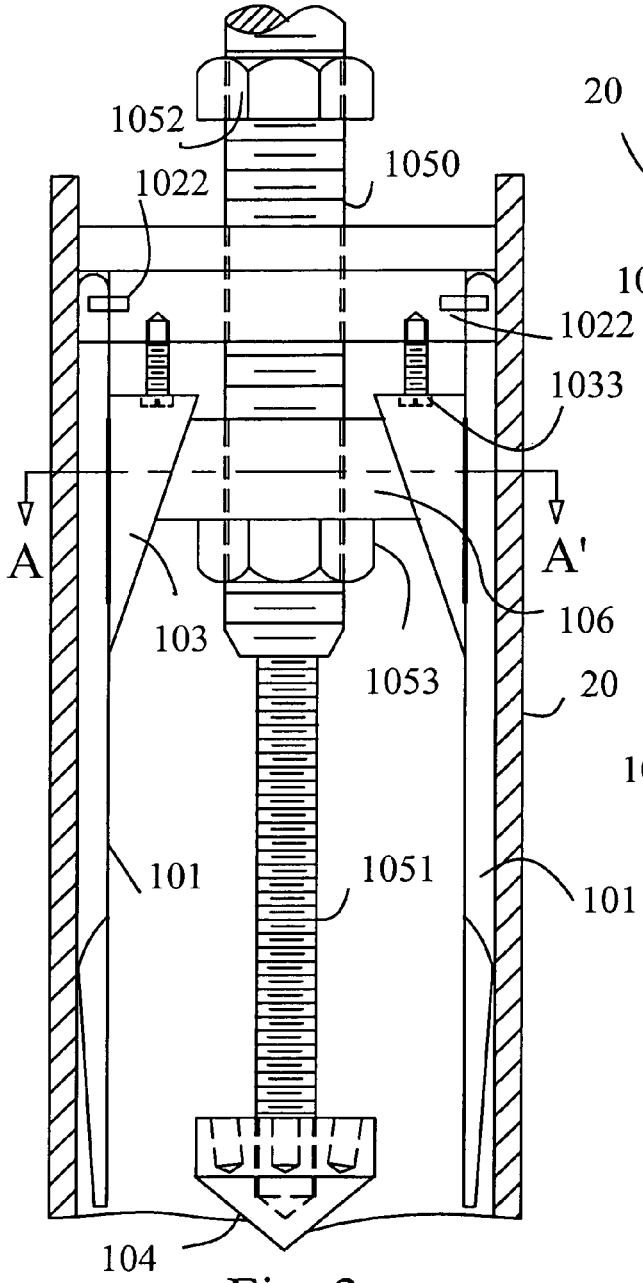
FIG. 3 illustrates the cam-action pipe puller apparatus set forth in FIG. 1 deployed within a pipe to be removed from or installed within a conduit.
Figure 7:
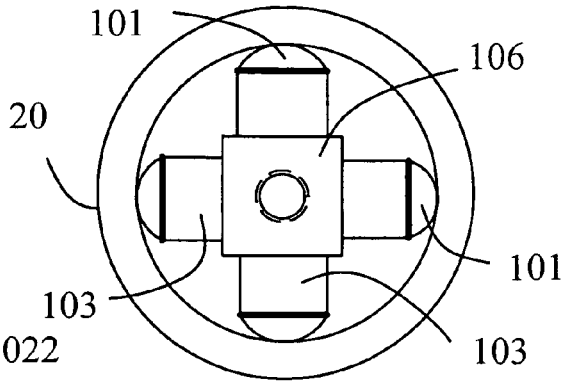
FIG. 7 is a view across section A-A of FIG. 3 showing the cam member in engagement with cam followers forcing the grasping members to engage the inner sides of the pipe.

Each grasping member 101, FIG. 7, has an arc-configured outer serrated surface formed to engage a portion of an inner surface of the pipe 20 so as to enable pipe puller 10 to pull the pipe 20 through the conduit and each has an inner surface with a triangular configured cam follower 103, FIG. 8, having aback section 1030 affixed thereto with a hypotenuse section 1031 thereof extending toward the center axis of pipe puller 10 and attached by a bolt 1033, FIGS. 2 and 3, to support member 102. A cam follower 103 may be attached to the flat inner surface of a grasping member 101 by having the cam follower back section 1030 welded thereto by a JB weld. Grasping members 101, FIG. 1, may also have different configurations of the serrated arc surfaces depending upon the type of pipe 20 to be pulled through or extracted from a conduit. For example, copper pipe may require that the serrated arc configuration of grasping member 101 be of a different configuration than a serrated arc configuration for a cast iron pipe or for that required for plastic or flexible pipe. Each design of the serrated arc surface is based on the specific configuration necessary for grasping member 101 to engage the inner sides of the pipe and pull or extract the pipe.

In the exemplary embodiment of the invention, the apparatus of the pipe puller 10 set forth in FIG. 1, has a circular top cap 100 having a diameter of a size to enable top cap 100 to slidably move along the inner sides of pipe 20. As set forth in FIG. 4, top cap has a center hole 1000 enabling eye bolt 105, FIG. 1, to move independently through top cap 100. Affixed to and positioned beneath top cap 100 and affixed thereto by pins is a generally square configured supporting member 102, FIG. 5, for movably supporting grasping members 101 and which moves in connection with top cap 100 smoothly along an upper portion of eye bolt 105, FIG. 1.

Figure 4:
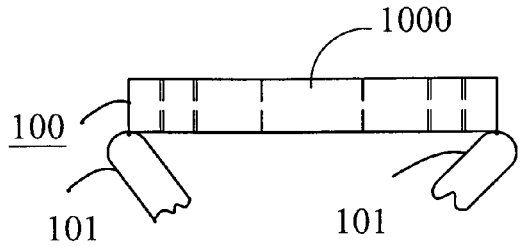
FIG. 4 illustrates a side view of a top cap adjacent retained grasping members of the pipe puller apparatus set forth in FIGS. 1 through 3.
Figure 5:
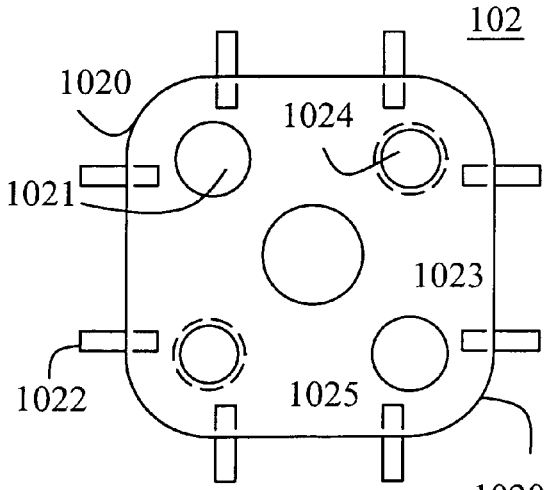
FIG. 5 illustrates a top view of a support member affixed to the top cap set forth in FIG. 4 and which movably supports the grasping members of the pipe puller apparatus set forth in FIGS. 1 through 3.

Supporting member 102, FIG. 5, is formed with rounded corners 1020 sized to slidably move along the inner sides of the pipe 20. Dowels 1022 extend outward from the sides thereof for movably supporting an upper end of each grasping member 101 such that the grasping members 101 are positioned at ninety degrees about the threaded eye bolt 105. When the bottom ends of grasping members 101, FIG. 2, are retained by retaining member 104, the diameter of the arc-configured outer surfaces at the combined top segments of the grasping members 101, FIG. 4, is greater than the diameter of the inside of the pipe 20 thereby preventing further entry of pipe puller 10 into pipe 20. The diameter of the arc-configured outer surfaces of grasping members 101, FIG. 3, is less than the pipe inside diameter when the grasping members 101 are released by the retaining member 104 thereby enabling top cap 100, supporting member 102 and the supported grasping members 101 released by the retainer member 104 to slidably move along the inner sides of pipe 20.

Pipe puller 10, FIG. 1, has plunger apparatus extending along the center axis of pipe puller 10 and slidably extending through top cap 100 and support member 102. In one embodiment of the invention, the plunger apparatus has an eye bolt structure 105, FIGS. 2 and 3, having an upper threaded bolt 1050 of a diameter sized to slidably move with respect to top cap 100 and support member 102. The eye bolt structure 105 has a bottom threaded bolt 1051 of a smaller sized diameter affixed to upper threaded bolt 1050 and which is affixed to a retaining member 104 for retaining grasping members 101 as pipe puller 10 is initially inserted into pipe 20. Although eye bolt structure 105 is illustrated as having threaded elements 1050 and 1051 it is to be understood that other threaded and non-threaded types of structures could be used.

Figure 6:
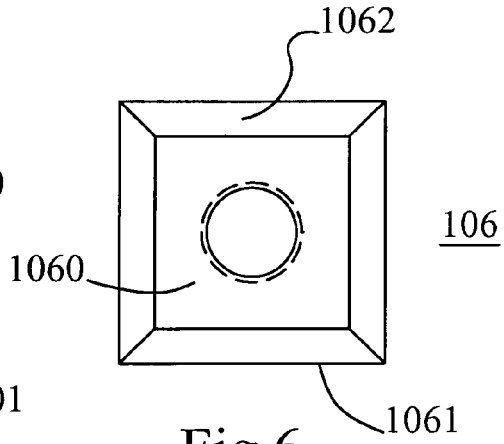
FIG. 6 illustrates a top view of a cam member of the pipe puller apparatus in FIGS. 1 through 3 for engaging grasping members inserted within a pipe to pull the pipe from or through a conduit.
Figure 9:
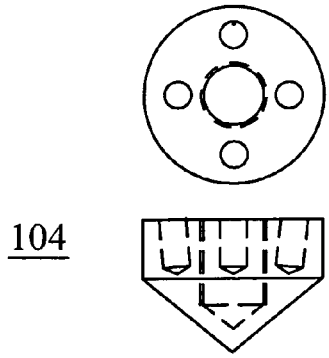

The plunger apparatus also has a truncated pyramid configured cam member 106, FIG. 6, affixed to the eye bolt member 105 between the supporting member 102, FIG. 2, and the retainer member 104. The truncated cam member 106 has a top surface 1060, FIG. 6, joined by slanted sides 1062 with a bottom surface 1061 and is positioned on the upper threaded bolt 1050 in a position such that slanted sections 1062 are normally disengaged from the hypotenuse section 1031 of grasping members cam followers 103 when they are engaged by the retaining member 104. Upward movement of eye bolt 105 positions the slanted sides 1062 of cam member 106 to engage the hypotenuse section 1031 of cam followers 103 to force the arc-configured outer serrated surface of each released grasping member 101 to engage the inner pipe surfaces so that pipe 20 may be removed from and pulled through the conduit. Eye bolt nuts 1052 and 1053, FIGS. 2 and 3, function to limit the downward movement of eye bolt 105 through top cap 100 when pipe puller 10 is initially inserted into pipe 20 and to help in supporting the cam member 106 when pipe puller 10 is removing or installing pipe 20 from or in conduits.

In operation, the end of retaining member 104, FIG. 1, while holding the lower ends of grasping members 101 is directed to the input of pipe 20 to guide pipe puller 10 to initially enter the input to pipe 20. Since the diameter of the arc-configured outer surfaces at the top segments of the grasping members 101, FIGS. 2 and 3, retained by the retaining member is greater than the diameter of the inside of the pipe 20, pipe puller 10 enters pipe 20 until the outer surfaces of the upper portion of retained grasping members 101 reach the edge of the pipe input and thereby prevents further entry of pipe puller 10 into pipe 20. Continued downward motion of eye bolt 105 of the plunger apparatus moves retainer member 104 to release the lower ends of grasping members 101 which then move outward with respect to support member 102, FIG. 3, such that the arc-configured outer surfaces at the top segments of the grasping members 101 are positioned inwardly to reduce the outer diameter of the grasping members 101 such that the top cap 100, support member 102 and grasping members 101 can move further into pipe 20. When eye bolt 105 of the plunger apparatus is subsequently pulled upward or in the opposite direction, the slanted sides 1062 of cam member 106 engage the hypotenuse section 1031 of the cam followers 103 to force the grasping members 101 serrated outer surfaces to engage the inner sides of pipe 20 thereby enabling pipe 20 to be removed from the conduit as eye bolt 105 is moved upward.

It is obvious from the foregoing that the facility, economy and efficiently of pipe pulling apparatus is improved by a pipe puller arranged to be inserted into a pipe and to expand grasping members when inserted into the pipe to forcibly engage inner walls of the pipe and remove the pipe and a submersible pump attached thereto from holes or conduits and to pull pipes through conduits to install the pipes therein. While the foregoing detailed description has described several embodiments of a pipe puller in accordance with principles of the invention, it is to be understood that the above description is illustrative only and is not limiting of the disclosed invention. Particularly other configurations of pipe puller grasping and cam members might be used within the pipe puller apparatus. Thus, the invention is to be limited only by the claims set forth below.

What is claimed is:

1. A cam-action pipe puller for pulling and extracting a pipe from and through a conduit comprising a plurality of grasping members each having an outer serrated surface formed to engage a portion of the inner side of the pipe so as to enable the pipe pulling and extracting apparatus to pull and extract the pipe, and pulling and extracting apparatus having a top cap having a diameter enabling the top cap to slidably move along the inner side of the pipe and having retainer means for engaging a lower end of the grasping members and guiding the pipe pulling and extracting apparatus into the pipe as the pipe pulling and extracting apparatus is initially inserted into the pipe with a top diameter of the grasping members greater than the inside diameter of the pipe thereby preventing further entry of the grasping members into the pipe and for releasing the lower ends of the grasping members after being further inserted into the pipe so that the grasping members top diameter is less than the pipe inside diameter thereby enabling the pipe puller to slidably move along the inner sides of pipe and having a cam for expanding the released ends of the grasping members to engage the inner side of the pipe when subsequently pulled outward from the pipe to pull and extract the pipe.

2. The pipe puller set forth in claim 1 wherein the pulling and extracting apparatus comprises a member affixed to the top cap and having a generally square configuration with rounded corners sized to slidably move along the inner side of the pipe for movably supporting the grasping members such that outer diameter of a top end of the grasping members when retained by the retainer means is greater than the diameter of the inner side of the pipe and is less than the pipe inside diameter when the grasping members are released by the retainer means thereby enabling the supporting member and supported grasping members released by the retainer means to slidably move along the inner side of the pipe.

3. The pipe puller set forth in claim 2 wherein the pulling and extracting apparatus comprises an eye bolt member affixed to the retainer means for holding the retainer means in engagement with the grasping members as the pipe pulling and extracting apparatus is initially inserted into the pipe and slidably movable with respect to the top cap and supporting member for positioning the retainer means to release the grasping members to enable the pipe pulling and extracting apparatus to be further inserted into the pipe.

4. The pipe puller set forth in claim 3 wherein the pulling and extracting apparatus comprises a plurality of cam followers each mounted on an inner surface of a corresponding grasping member and supported by the supporting member.

5. The pipe puller set forth in claim 4 wherein the cam comprises a cam member affixed to the eye bolt member between the supporting member and the retainer means in a position normally disengaged from the grasping members cam followers when they are engaged by the retainer means and positioned to engage the cam followers as the eye bolt member is moved outward with respect to the pipe to force the serrated surface of each grasping member to engage the inner pipe surface so that the pipe may be removed from and pulled through the conduit.

6. The pipe puller set forth in claim 5 wherein each cam follower comprises a generally right triangular configured member having a back section affixed to the inner surface of the grasping member and a hypotenuse section formed to engage the cam member as the eye bolt member is extracted from the pipe to force the grasping member serrated surface in engagement with the pipe inner surface.

7. The pipe puller set forth in claim 5 wherein each grasping member comprises a structure having an arc configured outer surface to slidably enter a pipe when one end is retained by the retainer means and the pipe pulling and extracting apparatus is initially inserted into the pipe and which outer surface is formed in serrated configurations to engage and hold inner surface of the pipe as the pipe pulling and extracting apparatus is attempted to be removed from the pipe.

8. A cam-action pipe puller for pulling and extracting a pipe through a conduit comprising a plurality of grasping members each having an arc-configured outer serrated surface formed to engage a portion of an inner surface of the pipe so as to enable the pipe puller to pull the pipe through the conduit and each grasping member having an inner surface with a cam follower affixed thereto, and cam apparatus having a threaded eve bolt affixed at one end to a retainer member for engaging a lower end of each grasping member as the pipe puller is initially inserted into the pipe and for releasing the lower ends of the grasping members as the cam apparatus is further inserted into the pipe and having a circular top cap slidably positioned on an upper portion of the threaded eye bolt opposite the retainer member and formed of a diameter enabling the top cap to slidably move along the inner surface of the pipe and having a generally square configured supporting member affixed to the circular top cap and slidably positioned on the upper portion of the threaded eye bolt and formed with rounded corners sized to slidably move along the inner surface of the pipe for movably supporting an upper end of each grasping member such that upper ends of the grasping members are positioned about the threaded eye bolt with the diameter of the arc-configured outer surfaces of the upper ends of the grasping members is greater than the diameter of the inner surface of the pipe when retained by the retainer member and is less than the pipe inside diameter when lower ends of the grasping members are released by the retainer member thereby enabling the supporting member and supported grasping members released by the retainer member to slidably move along the inner surface of the pipe and for engaging the cam followers to expand the released ends of the grasping members when subsequently pulled outward from the pipe to engage the inner surface of the pipe to enable the pipe puller to remove the pipe from the conduit.

9. The pipe puller set forth in claim 8 wherein the cam apparatus comprises a cam member affixed to the threaded eye bolt member between the supporting member and the retainer member in a position normally disengaged from the grasping members cam followers when they are engaged by the retainer member and positioned to engage the cam followers as the eye bolt member is moved outward with respect to the pipe to force the arc-configured outer serrated surface of each grasping member to engage the inner pipe surface so that the pipe may be removed from and pulled through the conduit.

10. A cam-action pipe puller for pulling and extracting a pipe through a conduit comprising a plurality of grasping members each grasping member having an arc-configured outer serrated surface formed to engage a portion of the inner surface of the pipe so as to enable the pipe puller to pull the pipe through the conduit, a threaded eye bolt affixed at one end to a retaining member for engaging a lower end of each grasping member and for guiding an end of the pipe puller into the pipe and retaining the grasping members as the pipe puller is initially inserted into the pipe, a circular top cap slidably positioned on a upper portion of the threaded eye bolt opposite the retaining member and formed of a diameter enabling the top cap to slidably move along the inner sides of the pipe, a generally square configured supporting member affixed to the circular top cap and slidably positioned on an upper portion of the threaded eye bolt and formed with rounded corners sized to slidably move along the inner surface of the pipe for movably supporting an upper end of each grasping member such that the grasping members are positioned at ninety degrees apart about the threaded eye bolt with the diameter of the arc-configured outer surfaces at the top segments of the grasping members when retained by the retaining member greater than the diameter of the inside of the pipe and is less than the pipe inside diameter when the grasping members are released by the retaining member thereby enabling the supporting member and supported grasping members released by the retainer member to slidably move along the inner surface of the pipe, a plurality of generally right triangular configured cam followers each having a back section affixed to the inner surface of a corresponding grasping member and a hypotenuse section formed to extend outward from the inner surface of the grasping member toward the threaded eye bolt for positioning the grasping member serrated surface to engage the pipe inner surface, and a cam member affixed to the threaded eye bolt between the supporting member and the retainer member in a position normally disengaged from the grasping members cam followers when they are engaged by the retaining member and positioned to engage the hypotenuse section of the cam followers as the threaded eye bolt is moved outward with respect to the pipe to force the serrated surface of each grasping member to engage the inner surface of the pipe so that the pipe may be removed from and pulled through the conduit.

11. A cam-action pipe puller for pulling and extracting a pipe through and from a conduit comprising a plurality of grasping members each positioned apart at ninety degrees around a center axis of the pipe puller from each adjacent grasping member and each grasping member having an arc-configured outer serrated surface formed to engage a portion of an inner surface of the pipe so as to enable the pipe puller to pull the pipe through the conduit and each grasping member having an inner surface with a triangular configured cam follower having a back section affixed thereto with a hypotenuse section thereof extending outward from the inner surface of the grasping member toward the center axis, and cam apparatus having a threaded eye bolt affixed at one end to a retainer member for retaining an end of the grasping members as the pipe puller is initially inserted into the pipe and for releasing the grasping members to further insert the pipe puller into the pipe and having apparatus slidably positioned on an upper portion of the eye bolt and sized to slidably move along the inner sides of the pipe for movably supporting an upper end of each grasping member such that the diameter of the arc-configured outer surfaces at the top segments of the grasping members when retained by the retainer member is greater than the diameter of the inside of the pipe and is less than the pipe inside diameter when lower ends of the grasping members are released by the retainer member and having a cam member affixed to the eye bolt in a position to engage the hypotenuse section of the cam followers when pulling the pipe puller from the pipe to expand the grasping members to engage the inner sides of the pipe thereby enabling the pipe to be removed from the conduit.

12. A cam-action pipe puller for pulling and extracting a pipe through and from a conduit comprising pipe grasping apparatus having a top cap sized to slidably move along inner walls of the pipe and which is affixed to a member for movably supporting an upper end of a plurality of grasping members each positioned at ninety degrees around a center axis of the pipe puller from each adjacent grasping member and each grasping member having an arc-configured outer serrated surface formed to engage a portion of an inner surface of the pipe so as to enable the pipe puller to pull the pipe through the conduit and each grasping member having an inner surface with a triangular configured cam follower having a back section affixed thereto with a hypotenuse section thereof extending toward the center axis, and plunger apparatus extending along the center axis of the pipe puller and slidably extending through the pipe grasping apparatus and having a retainer member affixed to one end for retaining ends of the grasping members with upper ends of the grasping members positioned such that the diameter of the arc-configured outer surfaces at the top segments of the grasping members when retained by the retaining member is greater than the diameter of the inside of the pipe when the pipe puller is initially inserted into the pipe and which plunger apparatus may be further inserted into pipe with respect to the pipe grasping apparatus to release the ends of the grasping members which has a cam member affixed thereto so that movement of the plunger apparatus in the opposite direction positions the cam member to engage the hypotenuse section of the cam followers to force the grasping members to engage the inner sides of the pipe thereby enabling the pipe to be removed from the conduit.

* * * * *

UNITED STATES PATENT AND TRADEMARK OFFICE

CERTIFICATE OF CORRECTION

PATENT NO. : 7,232,167 B2
APPLICATION NO. : 10/121411
DATED : June 19, 2007
INVENTOR(S) : Grady Odell Edwards It is certified that error appears in the above-identified patent and that said Letters Patent is hereby corrected as shown below:

Title page: should read as:

Item (76) Inventor: Grady Odell Edwards, 2917 Clark Shaw Rd., Powell, OH (US) 43065-8961

Col 4, line 29: should read,
--having a back section 1030 affixed thereto with a hypotenuse--.

Signed and Sealed this

Twenty-second Day of July, 2008

JON W. DUDAS
*Director of the United States Patent and Trademark Office*